US010548808B2

(12) United States Patent
Leier et al.

(10) Patent No.: US 10,548,808 B2
(45) Date of Patent: Feb. 4, 2020

(54) MASSAGE DEVICE

(71) Applicants: Expectations, LLC, Puyallup, WA (US); Beto Engineering & Marketing Co., Ltd., Taichung (TW)

(72) Inventors: Christopher Henry Leier, Taichung, WA (US); Steve Avila, Auburn, WA (US); Lopin Wang, Taichung (TW)

(73) Assignees: Expectations, LLC, Puyallup, WA (US); Beto Engineering & Marketing Co., Ltd., Beitun, Taichung (TW)

( * ) Notice: Subject to any disclaimer, the term of this patent is extended or adjusted under 35 U.S.C. 154(b) by 1044 days.

(21) Appl. No.: 15/008,734

(22) Filed: Jan. 28, 2016

(65) Prior Publication Data

US 2017/0216131 A1 Aug. 3, 2017

(51) Int. Cl.
*A61H 15/00* (2006.01)

(52) U.S. Cl.
CPC . *A61H 15/0092* (2013.01); *A61H 2015/0014* (2013.01); *A61H 2015/0028* (2013.01); *A61H 2201/0107* (2013.01); *A61H 2201/0153* (2013.01); *A61H 2201/0157* (2013.01); *A61H 2201/0161* (2013.01); *A61H 2201/164* (2013.01); *A61H 2201/1638* (2013.01);
(Continued)

(58) Field of Classification Search
CPC ..... A61H 7/003; A61H 7/007; A61H 7/001; A61H 7/00; A61H 2205/06; A61H 2205/106; A61H 2205/12; A61H 2201/1253; A61H 2201/0153; A61H 2207/00; A61H 2205/10; A61H 2205/081; A61H 7/002; A61H 7/004; A61H 2007/009; A61H 2201/1692; A61H 2201/1695
USPC ..... D24/211–214
See application file for complete search history.

(56) References Cited

U.S. PATENT DOCUMENTS

D185,246 S * 5/1959 Taran ..... 601/119
3,638,939 A * 2/1972 Langley ..... A61H 1/0244 15/230.11

(Continued)

FOREIGN PATENT DOCUMENTS

CN 2240349 Y * 11/1996
CN 2240349 Y 11/1996

(Continued)

OTHER PUBLICATIONS

English translation for CN2240349Y, Espacenet.com, translated on Sep. 12, 2019.*

(Continued)

*Primary Examiner* — Tu A Vo
(74) *Attorney, Agent, or Firm* — Charles E. Baxley

(57) ABSTRACT

A massage device includes a handle device having two end portions, two hand grips attached to the end portions of the handle device, and two spring biased lock devices are engaged into the end portions of the handle device and each include a projection for engaging with the handle device and for extending out of the handle device and for preventing the hand grips from being disengaged from the handle device. An arm is attached to one of the end portions of the handle device, and includes a sleeve for engaging onto the handle device and for engaging with one of the spring biased lock devices. One or more massage members are detachably attached to the end portions of the arm.

6 Claims, 8 Drawing Sheets

(52) U.S. Cl.
CPC ..... *A61H 2201/1652* (2013.01); *A61H 2201/1685* (2013.01); *A61H 2205/081* (2013.01); *A61H 2205/12* (2013.01)

(56) References Cited

U.S. PATENT DOCUMENTS 4,247,216 A * 1/1981 Pansini ..... B25G 3/18 15/1.7
4,266,536 A * 5/1981 Casares ..... A61H 15/0092 601/119
4,493,315 A * 1/1985 Iwahashi ..... A61H 7/001 601/135
4,798,198 A * 1/1989 Wright ..... A61H 7/003 601/119
4,807,603 A 2/1989 Yasui
4,944,747 A * 7/1990 Newth ..... A61H 7/001 601/135
5,502,901 A * 4/1996 Brown ..... A43B 1/0018 36/27
D445,196 S * 7/2001 Gladieux, III ..... D24/211
D445,508 S * 7/2001 Gladieux, III ..... D24/211
D461,009 S * 7/2002 Viner ..... D24/214
D463,029 S * 9/2002 Collins ..... D24/211
D539,915 S * 4/2007 Timmer ..... D24/214
7,213,350 B2 * 5/2007 Brown ..... A43B 1/0018 36/12
7,335,171 B2 * 2/2008 Ewell ..... A61H 7/001 601/135
D689,620 S * 9/2013 Louis ..... D24/215
D690,431 S * 9/2013 Nohr ..... D24/215
9,168,196 B2 * 10/2015 Dagan ..... A61H 7/003
9,532,918 B1 * 1/2017 Louis ..... A61H 7/003
2003/0009116 A1 * 1/2003 Luettgen ..... A61H 19/34 601/46
2003/0134726 A1 * 7/2003 Yu ..... A63B 21/00043 482/110
2007/0129656 A1 * 6/2007 Brooks ..... A61H 7/003 601/135
2007/0287938 A1 * 12/2007 Shields ..... A61H 15/0092 601/15
2008/0103421 A1 5/2008 Nicholson
2011/0224588 A1 * 9/2011 Grippo ..... A61H 7/003 601/135
2013/0012851 A1 * 1/2013 Fahmie ..... A61H 7/003 601/119
2013/0023807 A1 * 1/2013 Hennessey ..... A61H 7/003 601/119
2013/0226052 A1 * 8/2013 Niggemann ..... A61H 7/007 601/118
2015/0018731 A1 * 1/2015 La Peer ..... A61H 39/04 601/135
2015/0245977 A1 * 9/2015 Sungarian ..... A61H 15/00 601/118
2015/0305970 A1 * 10/2015 Lucey ..... A61H 15/0092 601/119
2015/0374576 A1 * 12/2015 Dagan ..... A61H 7/003 601/119
2016/0136032 A1 * 5/2016 Dakides ..... A61H 15/0092 601/113

FOREIGN PATENT DOCUMENTS

CN 2579405 * 10/2003
CN 2579405 Y 10/2003

OTHER PUBLICATIONS

English translation of CN2579405Y, Espacenet.com, translated on Sep. 12, 2019.*

* cited by examiner

MASSAGE DEVICE

BACKGROUND OF THE INVENTION

1. Field of the Invention

The present invention relates to a massage device, and more particularly to a massage device including an adjustable structure or configuration that may be easily and quickly changed or adjusted with different arrangement of the massage members and for conducting different massaging operations.

2. Description of the Prior Art

Various kinds of typical massage devices have been developed and comprise a harder or stronger inner housing, and a softer or resilient outer layer or outer housing for selectively contacting or engaging with or massaging the users.

For example, U.S. Pat. No. 4,807,603 to Yasui discloses one of the typical massage devices comprising a cylindrical and harder inner housing having a predetermined shape, and a softer or resilient outer layer or outer housing for selectively contacting or engaging with or massaging the users.

However, the outer layer or outer housing is solidly molded or formed on the inner housing, but may not be changed or adjusted relative to the inner housing, or no other different outer housings may be changed and attached onto the inner housing, such that the typical massage devices may not provide different massaging effects to the users.

The present invention has arisen to mitigate and/or obviate the afore-described disadvantages of the conventional massage devices or facilities.

SUMMARY OF THE INVENTION

The primary objective of the present invention is to provide a massage device including an adjustable structure or configuration that may be easily and quickly changed or adjusted with different arrangement of the massage members and for conducting different massaging operations.

The other objective of the present invention is to provide a massage device including an adjustable structure or configuration that may be easily and quickly made or manufactured or assembled by the manufacturers.

In accordance with one aspect of the invention, there is provided a massage device comprising a handle device including a first end portion having a first orifice formed therein, and a second end portion, a first hand grip attached to the first end portion of the handle device, a second hand grip attached to the second end portion of the handle device, and a first spring biased lock device engaged into the first end portion of the handle device, and including a first projection for selectively engaging with the first orifice of the handle device and for extending out of the handle device, and for preventing the first hand grip from being disengaged from the handle device and/or for limiting the first hand grip on the handle device.

The handle device includes a second orifice formed in the first end portion thereof, and the first spring biased lock device includes a second projection for selectively engaging with the second orifice of the handle device and for selectively engaging with the first hand grip. The first hand grip includes an aperture formed therein for selectively engaging with the second projection of the first spring biased lock device and for locking the first hand grip to the first end portion of the handle device and for preventing the first hand grip from being disengaged from the handle device.

The first hand grip includes a rake provided thereon for engaging with the user and for massaging the user. The first hand grip includes a channel formed therein, and a cable includes an end portion engaged with the channel of the first hand grip for attaching to the first hand grip of the handle device. The cable includes a foot engaging member for being stepped by a user and for training the upper muscle groups of the user.

The handle device includes a shaft, and a barrel having a chamber formed in the barrel for slidably engaging with the shaft and for allowing the barrel to be slidably engaged onto the shaft. The handle device includes two gaskets engaged between the shaft and end portions of the barrel for guiding the shaft and the barrel to move relative to each other.

The handle device includes a second spring biased lock device engaged into the second end portion of the handle device, and the second spring biased lock device includes a projection engaging with the handle device and extended out of the handle device for preventing the second hand grip from being disengaged from the handle device, and arranged for allowing the second hand grip and the barrel to be quickly removed or disengaged from the shaft when it is required to change or replace a new or different barrel or the like.

An arm may further be provided and attached to the second end portion of the handle device. The arm includes a sleeve extended outwardly therefrom for engaging onto the second end portion of the handle device and for detachably attaching to the second end portion of the handle device. The arm includes a cavity formed in the sleeve, and the second spring biased lock device is engaged into the second end portion of the handle device and includes a projection engaging with the handle device and extended out of the handle device for engaging with the cavity of the sleeve and for stably locking the sleeve to the handle device.

The arm includes a first end portion, and a first massage member detachably attached to the first end portion of the arm. The first massage member includes at least one wheel and at least one roller attached thereto for massaging various portions of the user. The arm includes a second end portion, and a second massage member detachably attached to the second end portion of the arm. The second massage member includes at least one wheel and at least one roller attached thereto for massaging various portions of the user.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
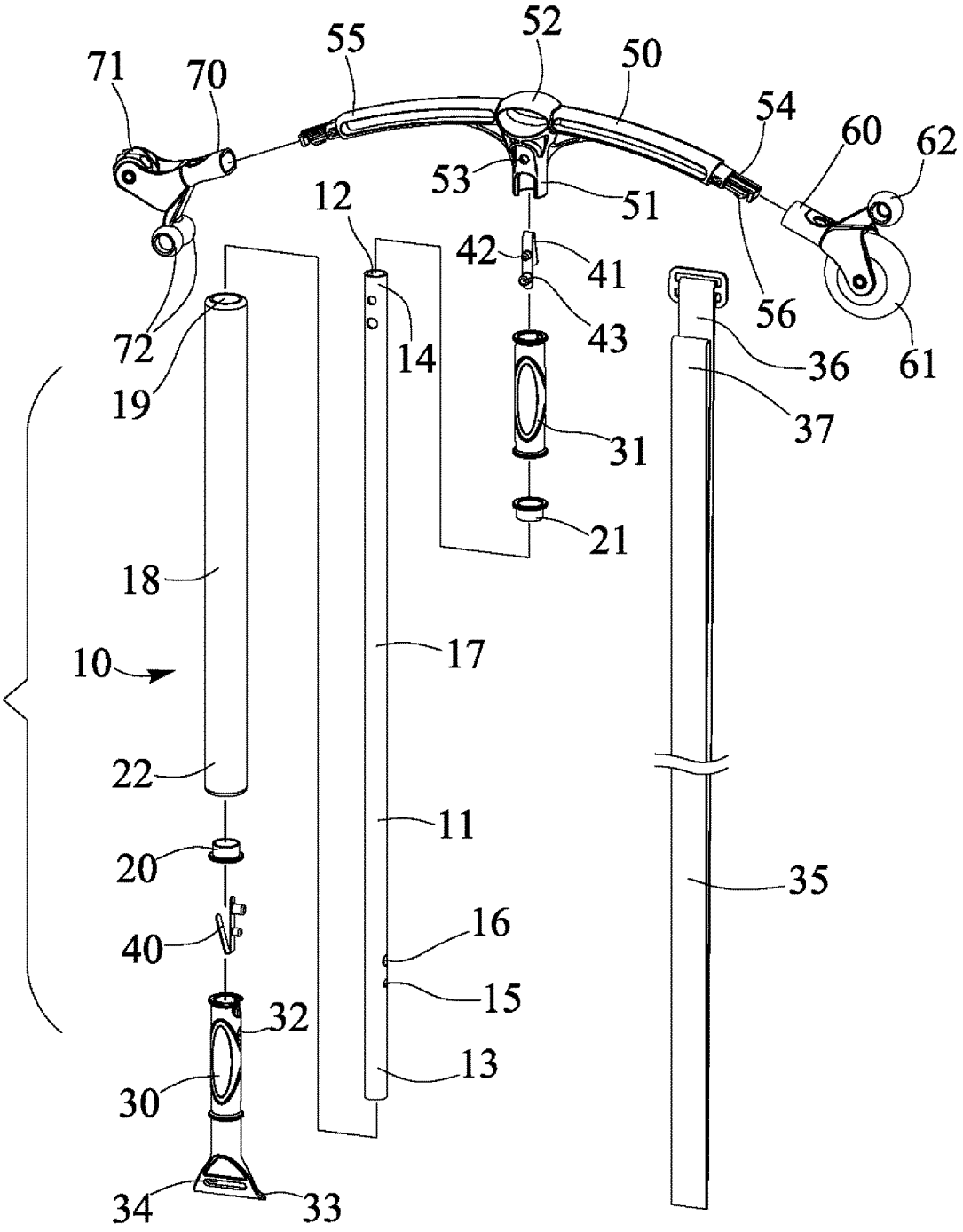
FIG. 1 is an exploded view of a massage device in accordance with the present invention.
Figure 2:
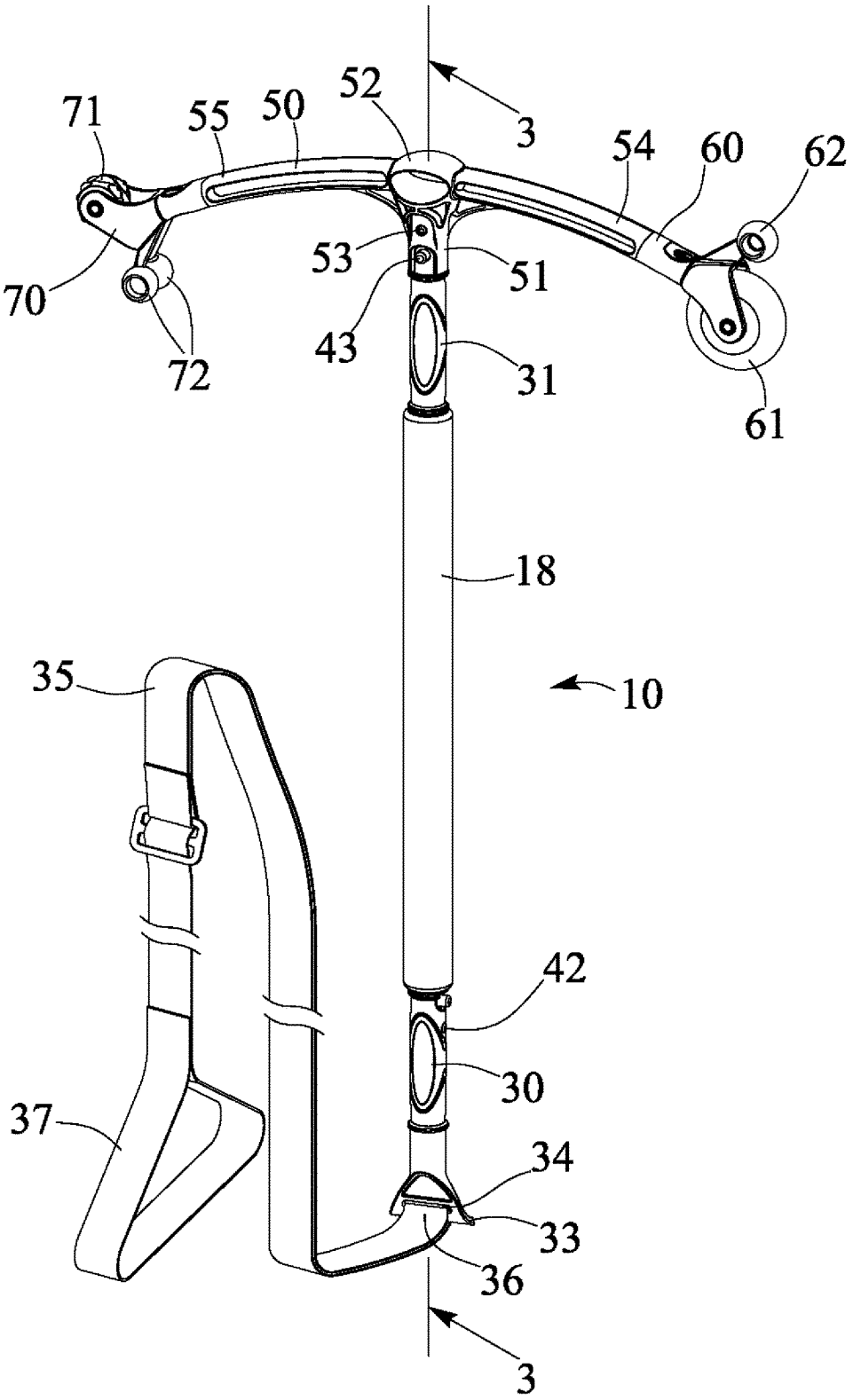
FIG. 2 is a perspective view of the massage device.
Figure 3:
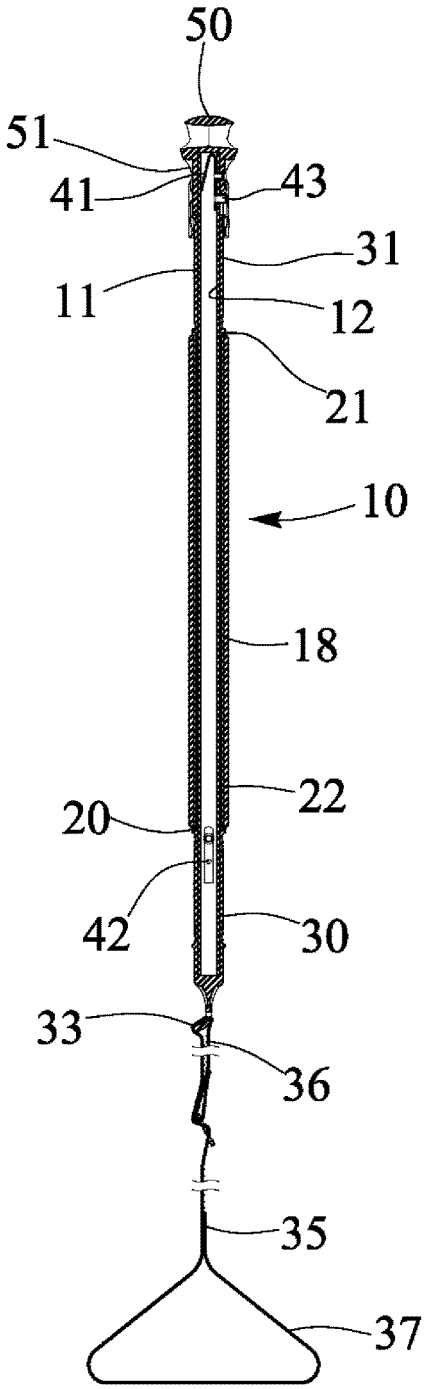
FIG. 3 is a cross sectional view of the massage device, taken along lines 3-3 of FIG. 2.
Figure 4:
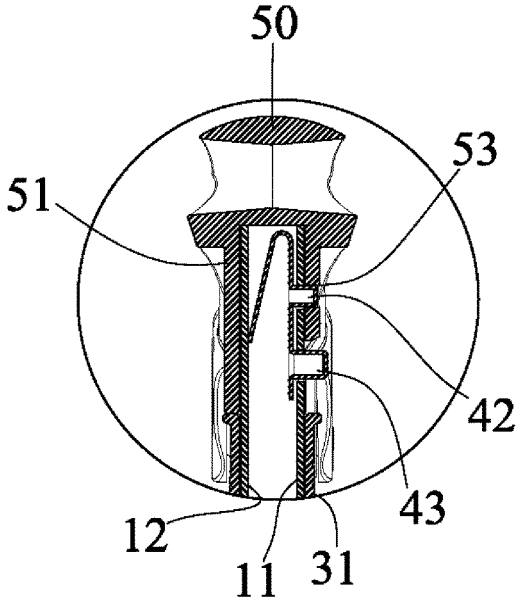
FIG. 4 is an enlarged partial sectional view of the massage device.

Referring to the drawings, and initially to FIGS. 1-4 and 6-9, a massage device in accordance with the present invention comprises a handle device 10 including an elongated or longitudinal spindle or shaft 11 having an elongated or longitudinal bore 12 formed therein, the shaft 11 or the handle device 10 includes two end portions 13, 14, such as a first end portion 13 and a second end portion 14, each having one or more (such as two) orifices 15, 16 formed therein, in which the first orifice 15 is located at the outer portion and closer to the free end portions 13, 14 of the shaft 11, and the second orifice 16 is located closer to the middle or intermediate portion 17 of the shaft 11. The handle device 10 may further include a cylindrical housing or barrel 18 having a compartment or chamber 19 formed therein for slidably receiving or engaging with the shaft 11 and for allowing the barrel 18 to be slidably or movably engaged onto the shaft 11.

Figure 10:
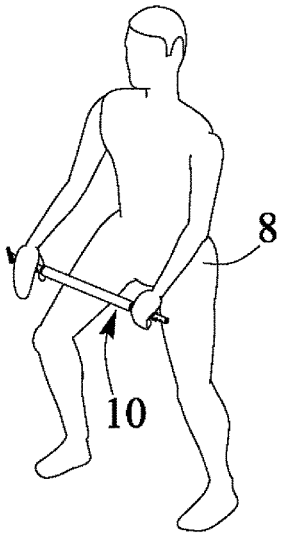
FIGS. 10, 11, 12 are perspective views illustrating the operation of the massage device.
Figure 11:
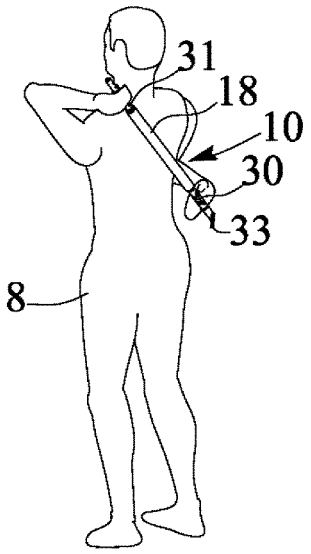

The handle device 10 may further include one or more (such as two) caps or gaskets 20, 21 fitted or engaged into or with the end portions 22 of the barrel 18 and snuggly fitted or engaged between the shaft 11 and the barrel 18 for guiding the shaft 11 and the barrel 18 to stably move or slide relative to each other. One or more (such as two) hand grips 30, 31, such as a first hand grip 30 and a second hand grip 31, are made of a relatively softer or resilient material, such as plastic, synthetic materials, rubber or the like for softly and comfortably contacting or engaging with the users, and are attached or mounted or secured to the end portions 13, 14 of the shaft 11 respectively for being grasped or held by the user 8 (FIGS. 10, 11). The barrel 18 is arranged and positioned and located between the hand grips 30, 31 which may anchor or retain the barrel 18 in place and may prevent the barrel 18 from being disengaged or separated from the shaft 11 of the handle device 10.

One or more (such as two) spring biased latch or lock devices 40, 41 are disposed or engaged into the end portions 13, 14 of the shaft 11 respectively, and each include one or more (such as two) tongues or projections 42, 43 extended outwardly therefrom for selectively engaging with or through the orifices 15, 16 of the shaft 11 and for extending out of the shaft 11 respectively. The barrel 18 and/or the hand grips 30, 31 may also be anchored or retained on the shaft 11 by the projections 43 of the spring biased lock devices 40, 41 which may further prevent the barrel 18 and/or the hand grips 30, 31 from being disengaged or separated from the shaft 11 of the handle device 10. One of the hand grips 30, or the first hand grip 30 may include a cavity or aperture 32 formed therein (FIG. 1) for selectively engaging with one of the projections 42 of the first spring biased lock device 40 which may solidly and stably anchor and retain or lock the first hand grip 30 to the first end portion 13 of the shaft 11.

Figure 7:
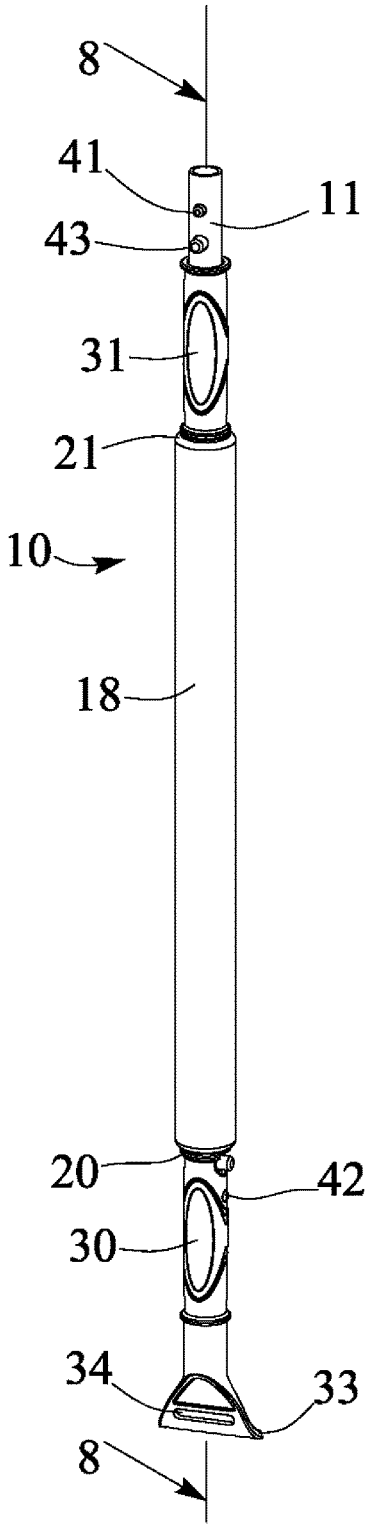
FIG. 7 is a perspective view illustrating the portion of the massage device as shown in FIG. 6.
Figure 8:
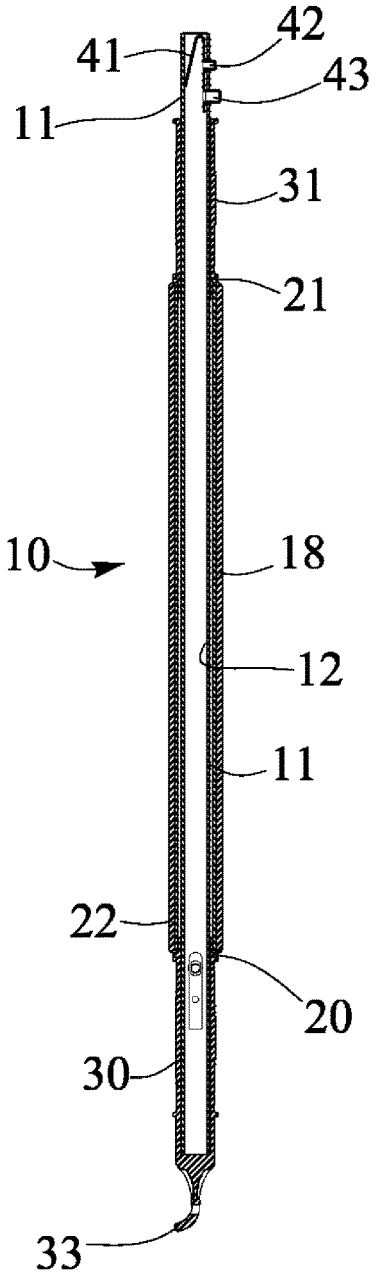
FIG. 8 is a cross sectional view of the massage device, taken along lines 8-8 of FIG. 7.
Figure 9:
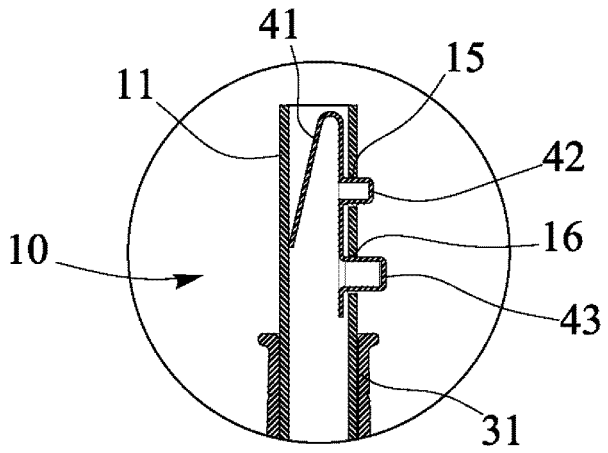
FIG. 9 is an enlarged partial sectional view of the massage device as shown in FIGS. 6-8.
Figure 12:
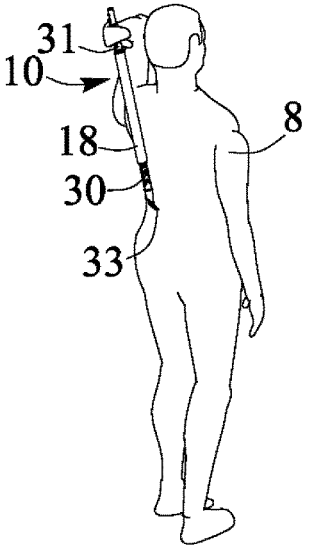
Figure 13:
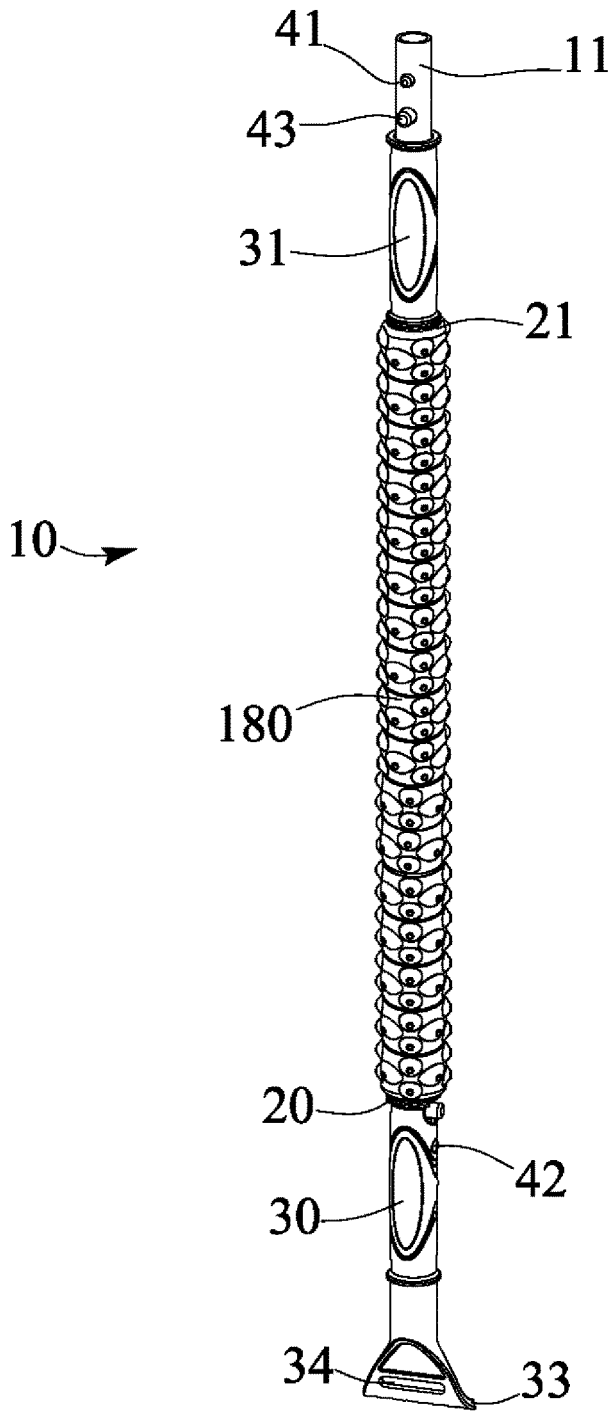
FIG. 13 is another perspective view similar to FIG. 7, illustrating the operation of the massage device.

It is to be noted that the projections 42, 43 of the second spring biased lock device 41 (FIGS. 7-9, 13) may be selectively depressed and forced into the shaft 11 for allowing the second hand grip 31 and the barrel 18 to be easily and quickly removed or disengaged or separated from the shaft 11, and for allowing the barrel 18 to be easily and quickly changed or replaced with the new or different ones 18, 180 (FIGS. 7, 13). One of the hand grips 30, or the first hand grip 30 may include a rake 33 formed or provided thereon for being used to scratch the user 8 as shown in FIG. 12, and may further include a passage or channel 34 formed therein for selectively engaging with one end portion 36 of an elastic strap or belt member or cable 35 (FIGS. 2, 3, 5), in which the cable 35 includes a foot engaging loop or member 37 for being stepped or engaged with the user 8 (FIG. 5).

As shown in FIGS. 1-5, the massage device further includes a curved bar or arm 50 having a tubular member or sleeve 51 extended outwardly therefrom or formed or provided on the middle or intermediate portion 52 of the arm 50 for engaging onto the second end portion 14 of the shaft 11, and the arm 50 includes a hole or cavity 53 formed in the sleeve 51 for selectively engaging with the projection 42 of the second spring biased lock device 41 (FIGS. 2-5) and for detachably latching or locking the arm 50 to the shaft 11, and it is preferable, but not necessary that the arm 50 is arranged substantially perpendicular to the shaft 11. The massage device further includes one or more (such as two) massage members 60, 70 to be detachably attached or mounted or secured to the two end portions 54, 55 of the arm 50 for selectively engaging with the user 8.

For example, the massage members 60, 70 may be detachably attached or mounted or secured to the two end portions 54, 55 of the arm 50 with spring biased latches 56. One of the massage members 60 may be detachably attached to one of the end portions 54 or the first end portion 54 of the arm 50, and includes one or more wheels 61 and one or more rollers 62 attached or mounted thereto for selectively engaging with the user 8 and for massaging purposes. The other massage member 70 may be detachably attached to the other end portions 55 or the second end portion 55 of the arm 50, and also includes one or more wheels 71 and one or more rollers 72 attached or mounted thereto for selectively engaging with the user 8 and for massaging purposes.

Figure 5:
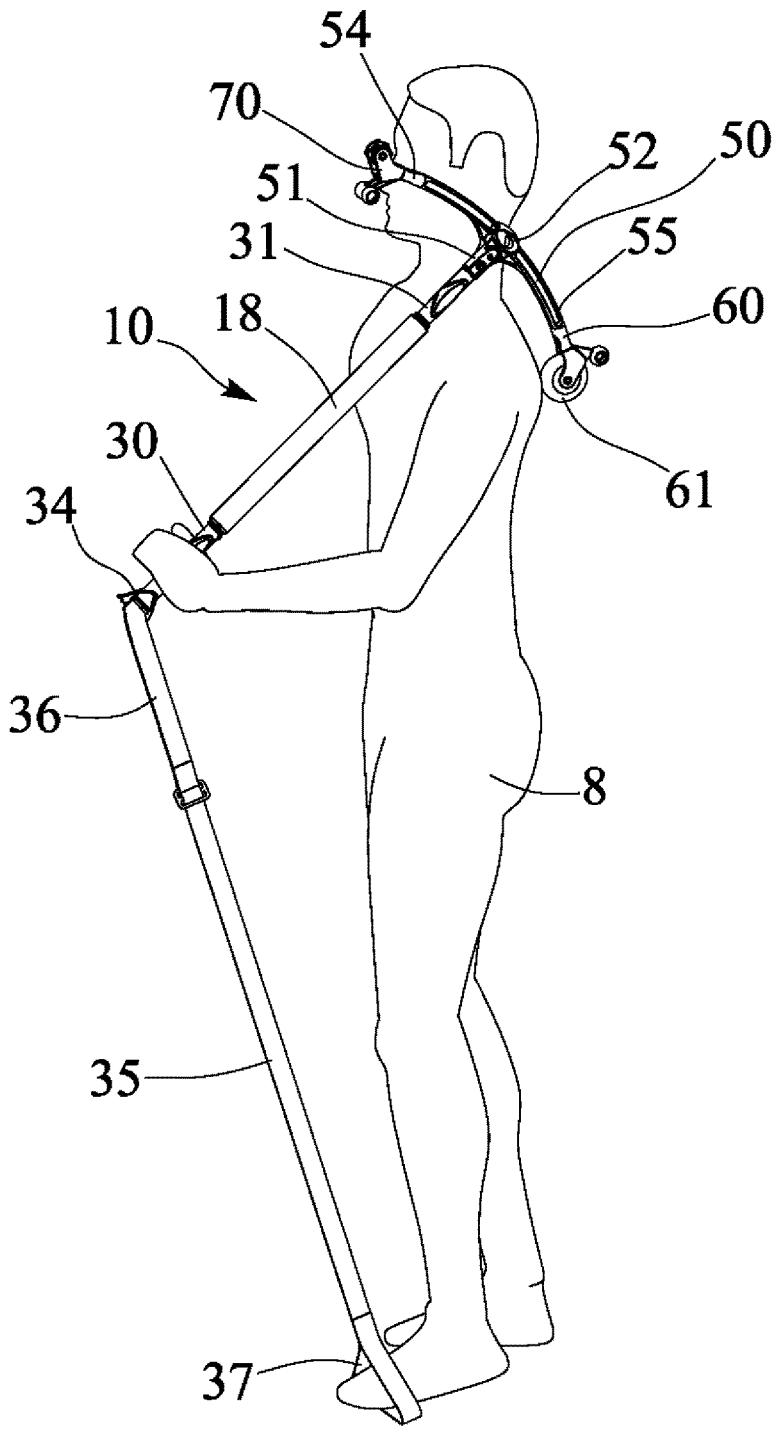
FIG. 5 is a perspective view illustrating the operation of the massage device.
Figure 6:
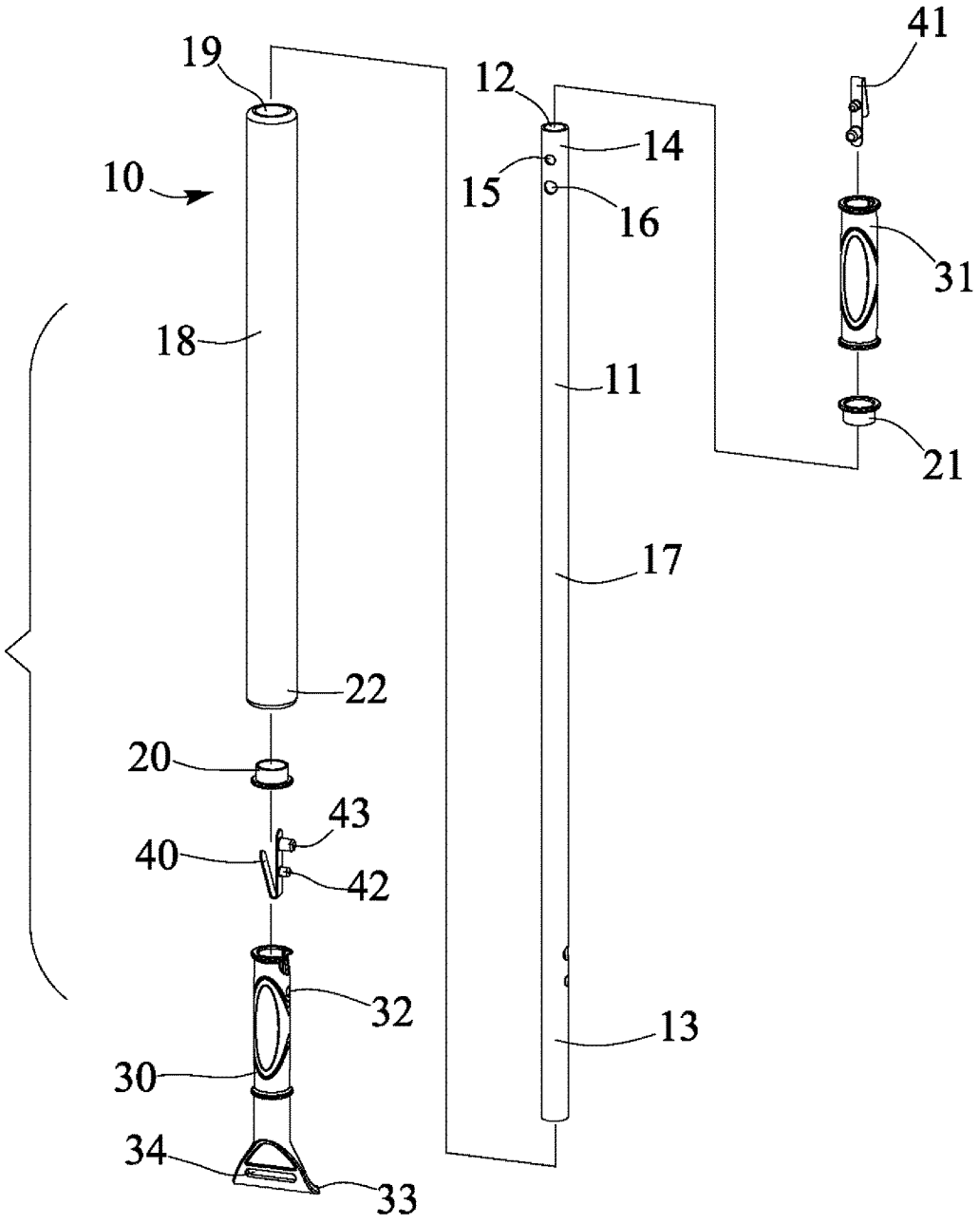
FIG. 6 is a partial exploded view illustrating a portion of the massage device.

In operation, as shown in FIG. 5, the user 8 may step on the foot engaging member 37 of the cable 35 and may hold and move one of the hand grips 30, 31 of the handle device 10 to train his muscle groups, and may also move the shaft 11 of the handle device 10 to have either of the wheels 61, 71 and/or rollers 62, 72 of the massage members 60, 70 to engage with the user 8 and to massage the user 8. As shown in FIGS. 10 and 11, without the arm 50 and the massage members 60, 70, the user 8 may also grasp or hold the hand grips 30, 31 of the handle device 10 to conduct or operate various kinds of exercise operations. As shown in FIG. 12, the user 8 may also grasp or hold the first hand grip 30 to scratch various portions of the user 8. The second hand grip 31 and the barrel 18 may be easily and quickly removed or disengaged or separated from the shaft 11, and for allowing the barrel 18 to be easily and quickly changed or replaced with the new or different ones 18, 180 (FIGS. 7, 13) by depressing and forcing the projections 42, 43 of the second spring biased lock device 41 (FIGS. 7-9, 13) into the shaft 11.

Accordingly, the massage device in accordance with the present invention includes an adjustable structure or configuration that may be easily and quickly changed or adjusted with different arrangement of the massage members and for conducting different massaging operations and that may be easily and quickly made or manufactured or assembled by the manufacturers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A massage device, comprising:

a shaft having a first end and a second end;

an arm having an intermediate portion interconnecting a first arm portion and a second arm portion, the first arm portion extends away from the intermediate portion in a first direction, and the second arm portion extends away from the intermediate portion in a second direction, opposite of the first direction;

a first massage member comprising a plurality of first massage member arms having at least one wheel and at least one roller, wherein the first massage member is releasably connected to the first arm portion via a first lock device;

a second massage member comprising a plurality of second massage member arms including at least one wheel and at least one roller, wherein the second massage member is releasably connected to the second arm portion via a second lock device;

a first grip operatively connected to the first end of the shaft and comprises a channel, wherein the first grip is releasably connected to the first end of the shaft via a third lock device;

a second grip operatively connected to the second end of the shaft;

a cylindrical housing configured to surround the shaft and is movably engaged onto the shaft between the first and second grips;

a belt member comprising a foot engaging member, wherein the channel is configured to receive the belt member; and wherein the intermediate portion is releasably connected to the second end of the shaft via a fourth lock device, the arm is arranged substantially perpendicular to the shaft, the first arm portion extending outward from a longitudinal axis of the shaft in the first direction away from the shaft, and the second arm portion of the arm extending outward from the longitudinal axis of the shaft in the second direction away from the shaft, opposite from the first direction.

2. The massage device of claim 1, further comprising a first cap engaged between the cylindrical housing and the shaft proximate to the first end of the shaft and a second cap engaged between the cylindrical housing and the shaft proximate to the second end of the shaft.

3. The massage device of claim 1, wherein the first grip including a rake configured and arranged for scratching.

4. The massage device of claim 3, wherein the rake includes the channel.

5. A massage device, comprising:

a shaft having a first end and a second end;

an arm having an intermediate portion interconnecting a first arm portion and a second arm portion, the first arm portion extends away from the intermediate portion in a first direction, and the second arm portion extends away from the intermediate portion in a second direction, opposite of the first direction;

a first massage member comprising a plurality of first massage member arms having at least one wheel and at least one roller, wherein the first massage member is releasably connected to the first arm portion via a first lock device;

a second massage member comprising a plurality of second massage member arms including at least one wheel and at least one roller, wherein the second massage member is releasably connected to the second arm portion via a second lock device;

a first grip operatively connected to the first end of the shaft, wherein the first grip is releasably connected to the first end of the shaft via a third lock device;

a second grip operatively connected to the second end of the shaft;

a cylindrical housing configured to surround the shaft and is movably engaged onto the shaft between the first and second grips;

a rake extends from the first grip, wherein the rake is configured for scratching, the rake comprising a channel that is configured for attachment of accessories; and wherein the intermediate portion is releasably connected to the second end of the shaft via a fourth lock device, the arm is arranged substantially perpendicular to the shaft, the first arm portion extending outward from a longitudinal axis of the shaft in the first direction away from the shaft, and the second arm portion of the arm extending outward from the longitudinal axis of the shaft in the second direction away from the shaft, opposite from the first direction.

6. The massage device of claim 5, further comprising a first cap engaged between the cylindrical housing and the shaft proximate to the first end of the shaft and a second cap engaged between the cylindrical housing and the shaft proximate to the second end of the shaft.

* * * * *